US005343962A

United States Patent [19]

Daigle et al.

[11] Patent Number: 5,343,962

[45] Date of Patent: Sep. 6, 1994

[54] DOUBLE ROD CYLINDER FEED SYSTEM

[75] Inventors: Odee P. Daigle; Laszlo Gyongyosi, both of Garland, Tex.

[73] Assignee: Ingersoll-Rand Company, Woodcliff Lake, N.J.

[21] Appl. No.: 107,415

[22] Filed: Aug. 16, 1993

Related U.S. Application Data

[63] Continuation of Ser. No. 933,846, Aug. 24, 1992, abandoned.

[51] Int. Cl.[5] ..... E21C 5/06

[52] U.S. Cl. ..... 173/147; 173/141

[58] Field of Search ..... 173/147, 151, 28, 141; 91/152, 153, 159

[56] References Cited

U.S. PATENT DOCUMENTS

| | | | |
|---|---|---|---|
| 1,781,707 | 11/1930 | Sheldon . | |
| 2,109,782 | 3/1938 | Rose et al. . | |
| 2,192,909 | 3/1940 | Hoffar . | |
| 2,276,016 | 3/1942 | Brantly . | |
| 2,570,308 | 10/1951 | Beeth . | |
| 2,631,821 | 3/1953 | Caldwell . | |
| 2,638,324 | 5/1953 | Ball et al. . | |
| 2,730,331 | 1/1956 | Harinck . | |
| 2,829,865 | 4/1958 | Wagner et al. . | |
| 3,124,979 | 3/1964 | Macks . | |
| 3,131,776 | 5/1964 | Kvello-Aune et al. . | |
| 3,662,611 | 5/1972 | Knoll . | |
| 3,674,098 | 7/1972 | Virgo . | |
| 3,692,123 | 9/1972 | Gyongyosi | 173/147 |
| 3,708,020 | 1/1973 | Adamson . | |
| 3,719,238 | 3/1973 | Campbell et al. . | |
| 4,050,526 | 9/1977 | Deike . | |
| 4,085,796 | 4/1978 | Council . | |
| 4,336,840 | 6/1982 | Bailey | 173/28 X |
| 4,478,291 | 10/1984 | Futros | 173/147 |
| 4,503,917 | 3/1985 | Hargenrader et al. | 173/147 |
| 4,585,080 | 4/1986 | Bender . | |
| 4,650,011 | 3/1987 | Barbieri . | |
| 4,671,365 | 6/1987 | Back et al. | 173/147 X |
| 4,676,312 | 6/1987 | Mosing et al. . | |
| 4,735,270 | 4/1988 | Fenyvesi . | |
| 4,953,639 | 9/1990 | Hamner et al. . | |
| 4,991,493 | 2/1991 | Luojus | 92/75 X |

FOREIGN PATENT DOCUMENTS

| | | | |
|---|---|---|---|
| 2526883 | 11/1983 | France | 92/75 |
| 623018 | 7/1978 | U.S.S.R. | 92/75 |

*Primary Examiner*—Rinaldi I. Rada
*Attorney, Agent, or Firm*—John J. Selko

[57] ABSTRACT

A hydraulic system for moving a drilling head in a rectilinear motion between a mast crown and a mast table on a drilling machine includes a double rod hydraulic cylinder connected at a bottom end to a mast table and at a top end to a traveling sheave block; first and second flexible connector members for connecting a drilling head to the mast through the sheave block; and hydraulic feed circuitry for actuating the cylinder to move the sheave block and drilling head alternately in a first pulldown direction and in a second pullback direction.

11 Claims, 9 Drawing Sheets

DOUBLE ROD CYLINDER FEED SYSTEM

This application is a continuation of application Ser. No. 07/933,846, filed Aug. 24, 1992 now abandoned.

BACKGROUND OF THE INVENTION

This invention relates generally to drilling machines and more particularly to systems for raising and lowering drilling heads on drilling machines. Drilling machines used in applications such as blast hole, water well, shallow oil and gas exploration, require the use of long straight sections of drill pipe which are connected to the rotary drilling device, (rotary head), to perform the drilling process. Most drilled holes are deep enough to require additional drill pipe to be added to the drill string to complete the hole. Subsequently, each added drill pipe must be removed from the drill string before the drilling machine can be moved to the next hole location.

It is advantageous to reduce time intensive procedures from the drilling process that are not actually performing the drilling of the hole. One trend is to lengthen each section of drill pipe which reduces the number of sections to be added and eventually subtracted from the drill string. Logically, increasing the feed speeds up and down would also reduce the trip time for each drilled hole.

There are basically two types of systems that control the up and down rectilinear motion and feed forces of the rotary head. They are cylinder feed and motor feed.

Motor feed systems are very expensive compared to the cylinder feed systems. This is mainly due to the fact that roller chains must be used. These chains are extremely heavy. Handling the extra weight requires a robust tower which adds cost. Drive motors, fail-safe brakes, and speed reducing planetary gear boxes are other essential and expensive items which are characteristic of motor feed systems.

A motor feed system is normally used when the rotary head travel becomes so long that it is impractical to use a cylinder for feed control. This is because the piston rod diameter must be sized larger to prevent buckling. At the same time, it forces the bore diameter of the cylinder to grow so the pulldown and pullback force requirements can be maintained. Consequently, the feed speeds slow down because the volumes on both sides of the piston have increased. To combat the slow speeds, larger and more expensive pumps must then be selected. Also, the hydraulic system as a whole must be more expensive to handle the larger flow required.

The foregoing illustrates limitations known to exist in present feed systems for drilling machines. Thus it is apparent that it would be advantageous to provide an alternative directed to overcoming one or more of the limitations set forth above. Accordingly a suitable alternative is provided including features more fully disclosed hereinafter. The system described here allows the use of a cylinder feed system for drill rod lengths that, in the past, would have required the use of an expensive motor feed system.

SUMMARY OF THE INVENTION

In one aspect of the present invention, this is accomplished by providing a double rod hydraulic cylinder movable over at least a part of the length of a mast, said cylinder being connected at a bottom end to a mast table and at a top end to a traveling sheave block; said sheave block movable over at least part of the length of the mast, said sheave block having an upper and lower sheave connected thereto; first flexible connector means for connecting a bottom end of said drilling head to said mast through first sheaving on said mast table and through said lower sheave of said sheave block; second flexible connector means for connecting a top end of said drilling head to said mast crown through second sheaving on said mast crown and through said upper sheave on said sheave block; and hydraulic feed means for actuating said cylinder to move said sheave block and said drilling head alternately in a first pulldown direction and in a second pullback direction.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION OF INVENTION

Figure 1:
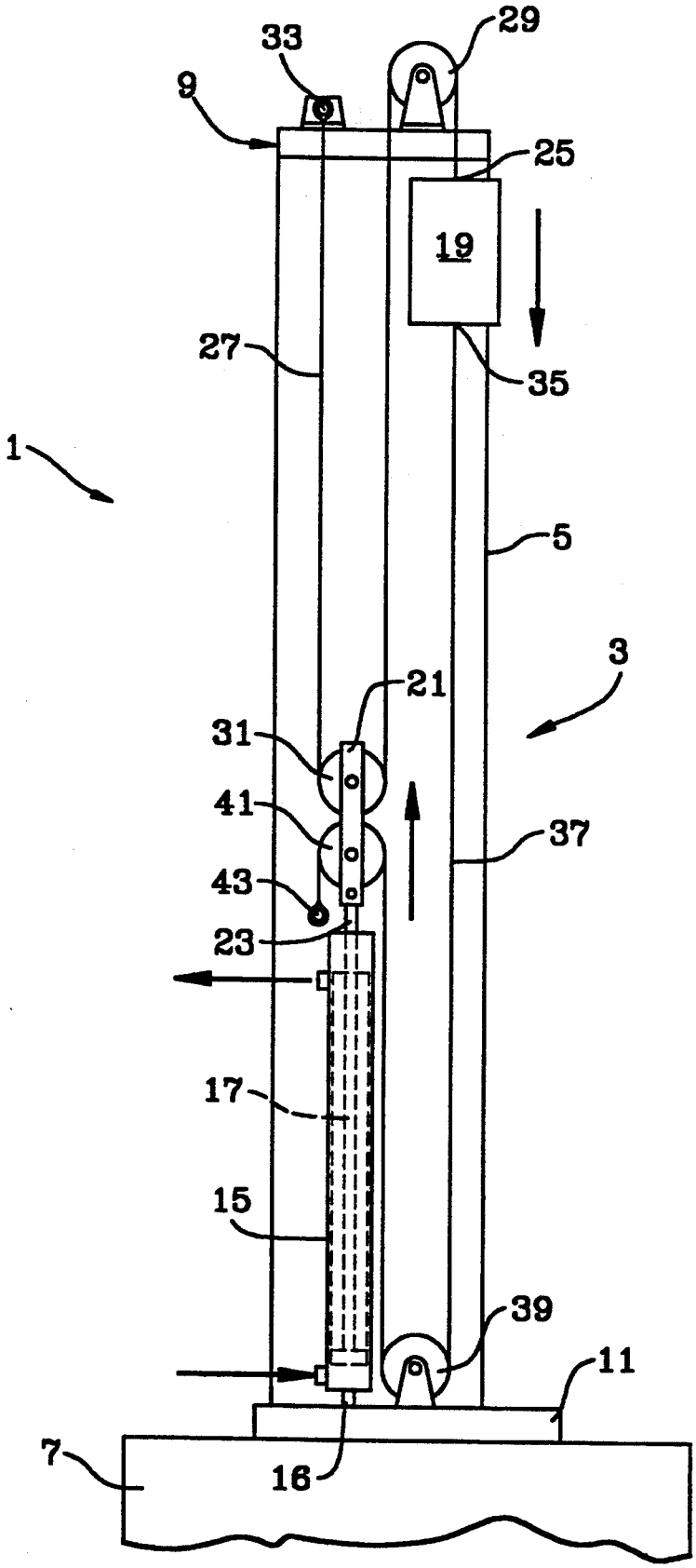
FIG. 1 (PRIOR ART)
FIG. 1 is a schematic side elevational view of a prior art cylinder feed system, with the mast shown in phantom and other parts removed, with the drilling head at the end of a pullback position.
Figure 2:
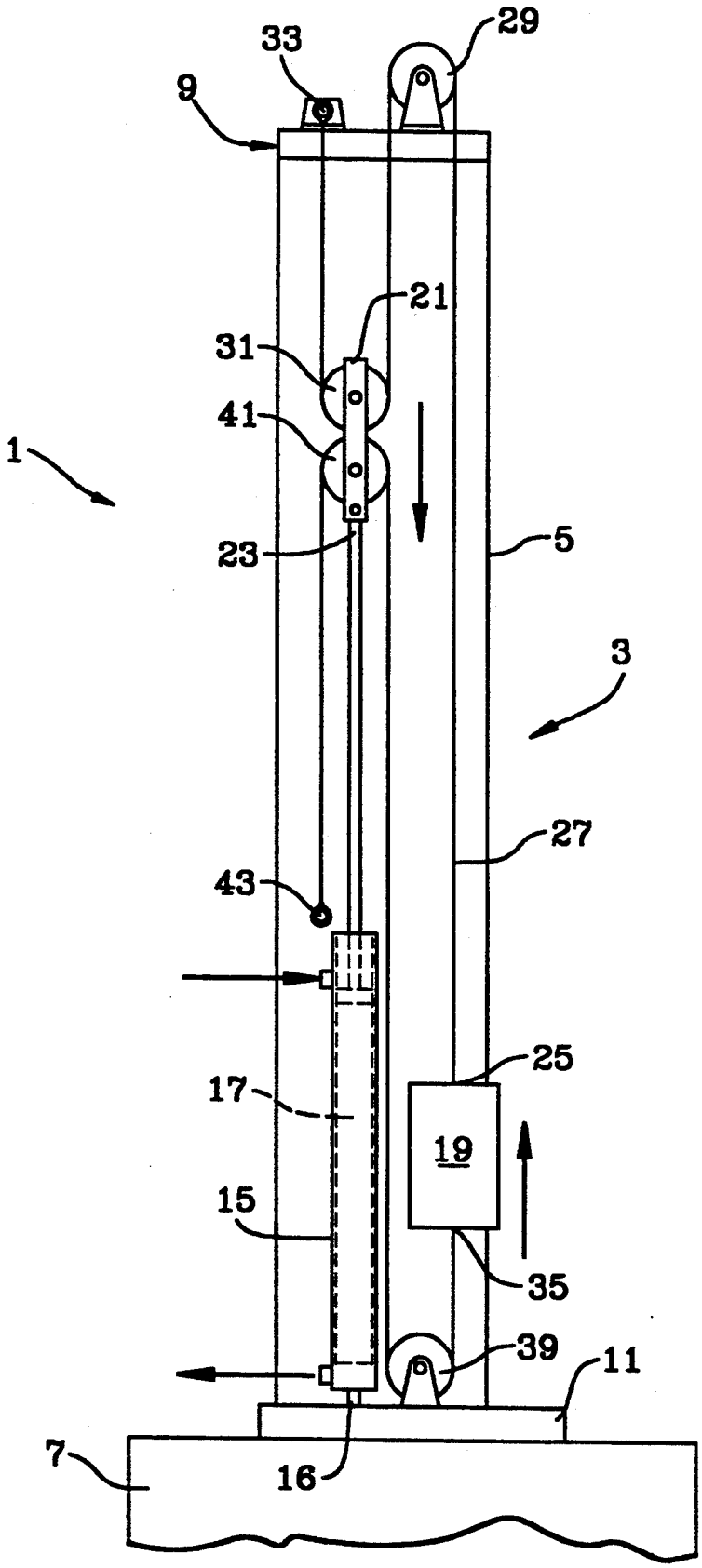
FIG. 2 (PRIOR ART)
FIG. 2 is a view similar to FIG. 1 with the drilling head at the end of a pulldown position.

Referring to FIGS. 1 and 2, there is shown the conventional drilling machine 1 having a conventional cylinder feed system 3. The drilling machine is comprised of a tower, or mast, 5 (shown in phantom). Mast 5 can be mounted on a mobile rig 7 or may be ground supported. Mast 5 may be of generally conventional construction using standard structural steel bracing and wide flange I beam or structural tubing members. Mast 5 includes a top portion, referred to as a mast crown 9, and a bottom portion referred to as a mast table 11. Mast table 11 is suitably connected to the mobile rig or supported on the ground by conventional means. Mast 5 may or may not be pivotably mounted on a mobile rig.

Conventional cylinder 15 uses one piston rod 17 to transmit the force and position to the rotary drillhead 19. As is well known, attached to the drill head 19 and rotated thereby is a drill pipe (not shown). The drill pipe is rotated and forced down into a drillhole to cause a drill bit (not shown) to bore a hole.

Piston rod 17 is sized to handle a compressive force at an unsupported length without buckling. The unsupported length is usually slightly greater than the stroke length.

In the conventional feed system, a barrel of hydraulic cylinder 15 is securely connected to the mast table 11 at the bottom end 16 of cylinder 15. At the upper end of cylinder 15, a traveling sheave block 21 is affixed to the end 23 of piston rod 17. With piston rod 17 retracted, (See FIG. 1) the rotary head 19 will be at the top of the mast 5 at the end of a pullback position. On the top of the rotary head 19, one end 25 of a pullback chain/cable 27 is attached. The pullback chain/cable 27 is then reeved over the top of a crown sheave 29 which is located on crown 9 at the top of the mast 5. From there, it passes down to upper sheave 31 of the traveling sheave block 21 and then back to the crown 9 at the top of the mast 5 where the other end 33 is anchored. Fastened to the bottom of the rotary head 19 is one end 35 of the pulldown chain/cable 37. The pulldown chain/-cable 37 drops down and loops under the pulldown sheave 39 that is located at the mast table 11. It is strung up to the bottom sheave 41 located on the travelling sheave block 21 and the other end 43 is affixed to the mast 5 at a position between crown 9 and mast table 11. Any position between the lower end of traveling sheave block 21 and mast table 11 will work. With piston 17 extended (see FIG. 2) the rotary head 19 will be at the bottom of mast 5 at the end of a pulldown position.

Figure 3:
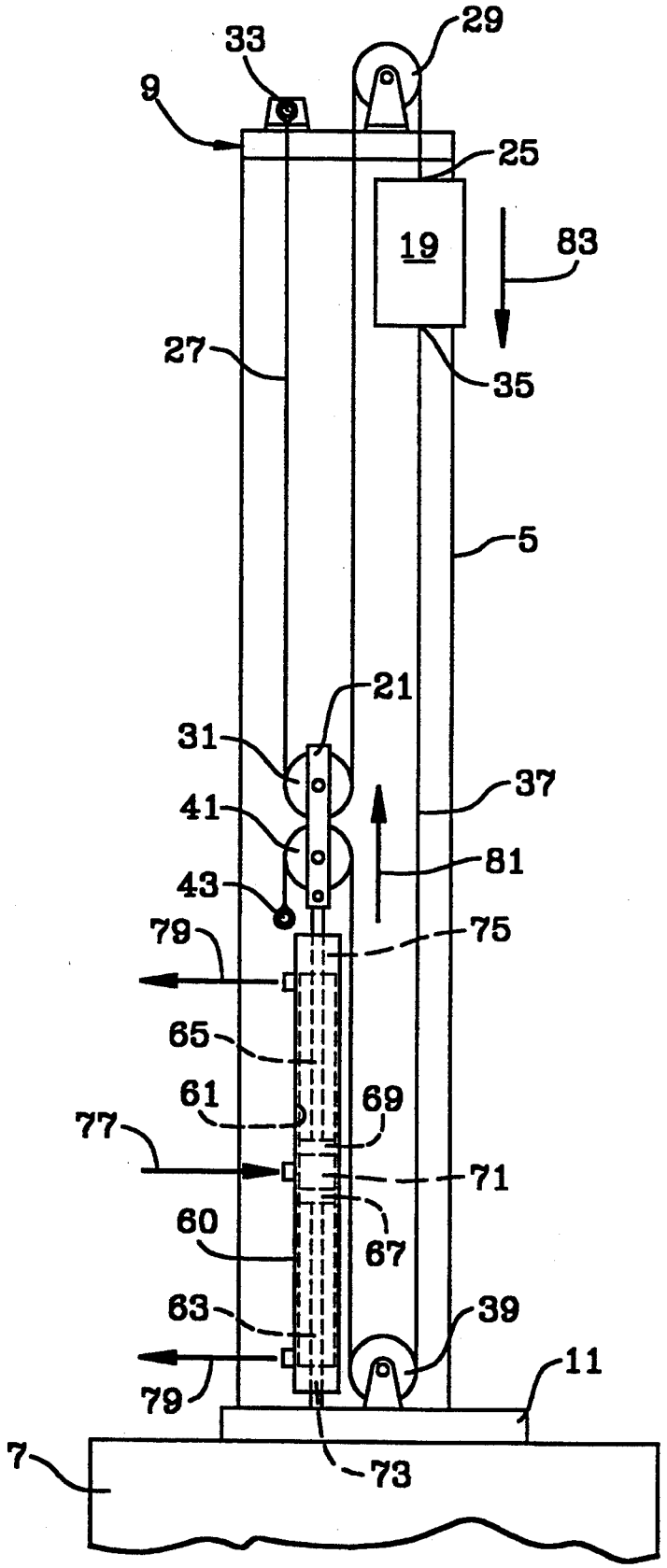
FIG. 3 is a schematic side elevational view of a cylinder feed system of this invention, with the mast shown in phantom and other parts removed, with the drilling head at the end of a pullback position.
Figure 4:
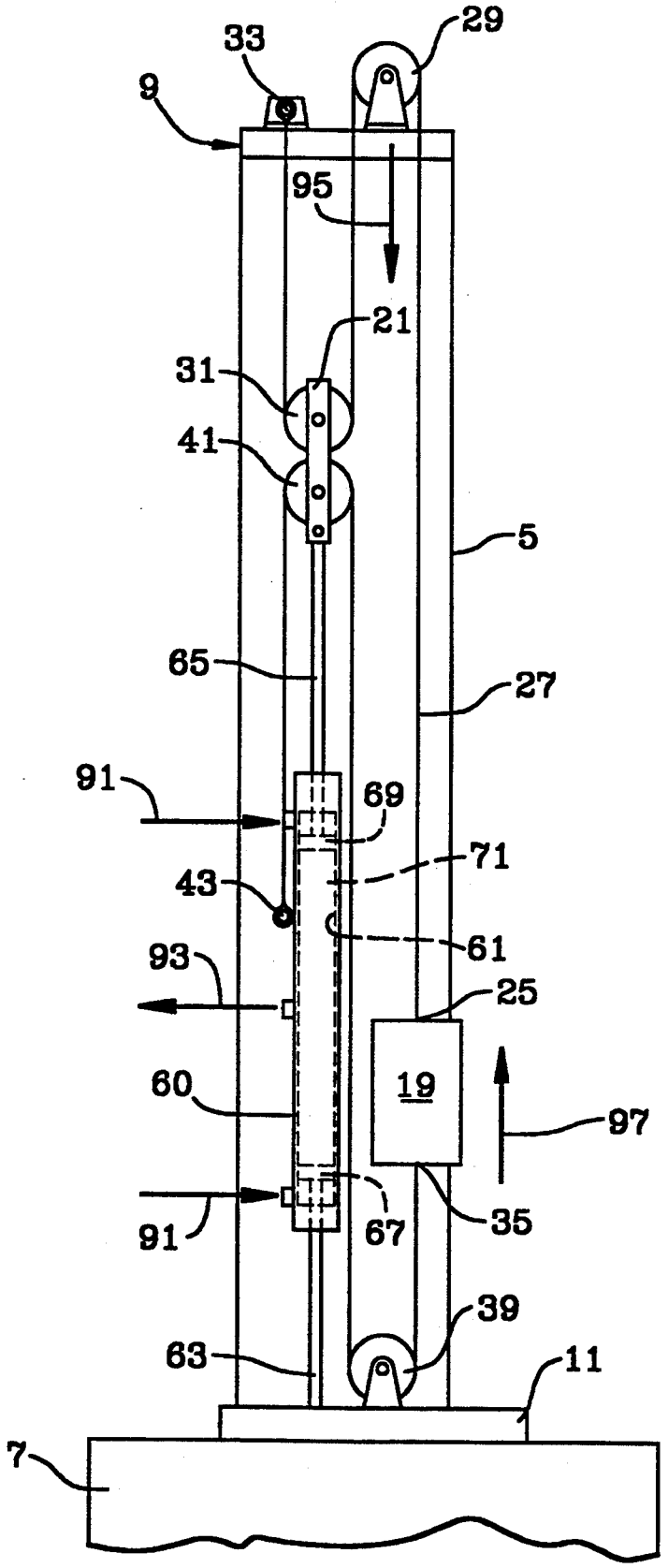
FIG. 4 is a view similar to FIG. 3 with the drilling head at the end of a pulldown position.

Referring to FIGS. 3 and 4, there is shown one embodiment of the invention. A double rod cylinder 60, having a barrel 61, includes a first piston rod 63 slidably mounted within barrel 61, and a second piston rod 65 likewise slidably mounted within barrel 61. Rod 63 has a piston head associated therewith, and rod 65 likewise has its own associated piston head 69. Piston heads 67, 69 on their first sides adjacent to each other are in fluid communication with a common, volumetrically variable, chamber 71 in cylinder barrel 61. First piston head 67, on its second, opposite side, is in fluid communication with a volumetrically variable chamber 73 in barrel 61 between piston head 67 and bottom end of barrel 61. Likewise, second piston head 69, on its second, opposite side, is in fluid communication with a volumetrically variable chamber 75 in barrel 61 between piston head 69 and top end of barrel 61. The remainder of the elements are the same as described hereinabove for FIGS. 1 and 2, and are so numbered.

The operation of the invention is as follows: During a typical drilling cycle when pulldown (lowering the rotary head 19) force is required, pressurized hydraulic oil is directed into the cylinder, into the common chamber 71, as shown by arrow 77 of FIG. 3. The increased volume between the two pistons 67, 69 begins to force the upper rod 65 out of the cylinder barrel 61 and, thereafter pushes the barrel 61 upward. Simultaneously, hydraulic oil is forced out of the volumetrically decreasing cavities 73, 75 on the opposite sides of the pistons 67, 69, as shown by arrows 79 of FIG. 3. The hydraulic force generated, and upward movement (arrow 81) is exerted to the traveling sheave block 21. The force and upward displacement is transmitted to the rotary head 19 via chain or cable 37 as a pulldown force and a downward displacement (arrow 83 of FIG. 3).

When the piston rods 63, 65 have "stroked out", the rotary head 19 has traveled the full length of the mast 5. (See FIG. 4). This rotary head 19 travel is twice the distance of the total cylinder stroke. In other words, the system has a 2:1 rotary head travel advantage relative to the total cylinder stroke.

In the pullback (raising the rotary head 19) mode, pressurized hydraulic oil is directed into the cylinder 61, as shown by arrows 91 of FIG. 4. The increased volume between the each piston 67, 69 and the cylinder barrel ends begin to force the upper rod 65 back into the cylinder barrel 61 and, thereafter pushes the barrel 61 downward. Simultaneously, hydraulic oil is forced out of the volumetrically decreasing cavity 71 between the pistons 67, 69, as shown by arrow 93 of FIG. 4. The hydraulic force generated, and downward movement (arrow 95) are exerted to the traveling sheave block 21. The force and downward displacement are transmitted to the rotary head 19 via chain or cable 27 as a pullback force and an upward displacement, as shown by arrow 97 in FIG. 4.

Figure 7:
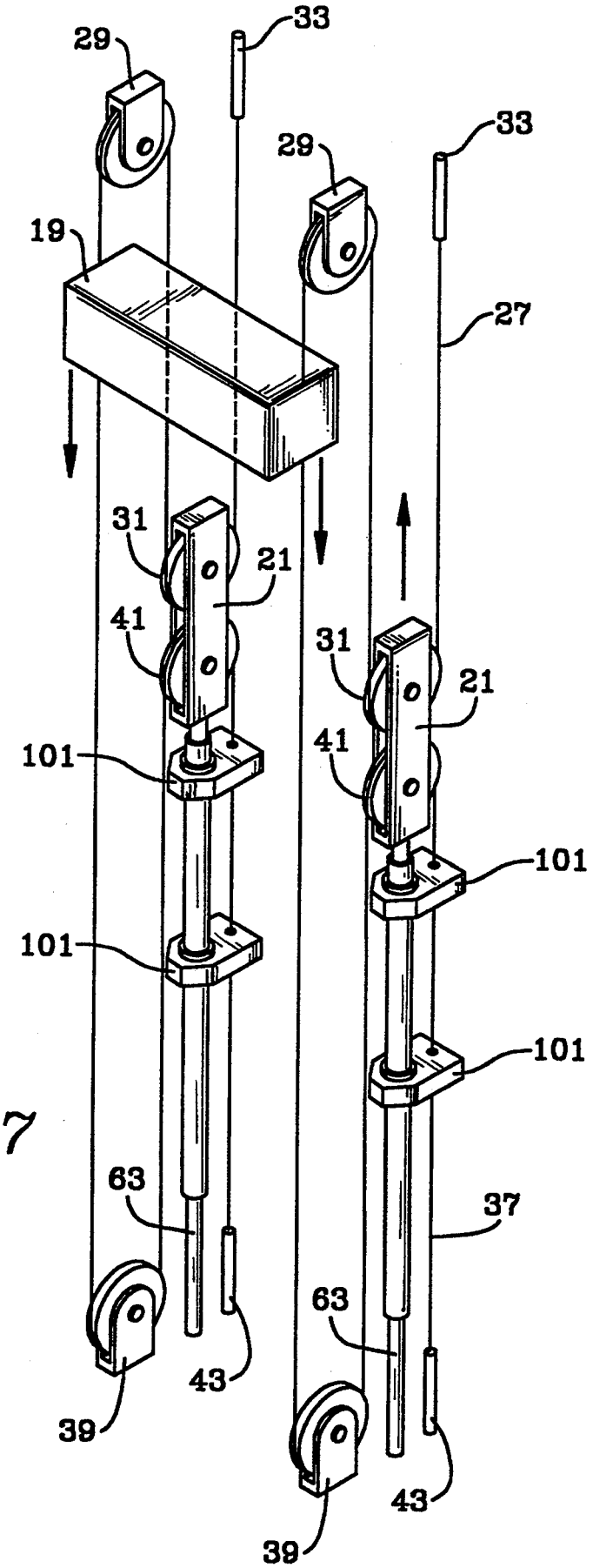
FIG. 7 is a perspective schematic view of a cylinder feed system of this invention, with parts removed, with the drilling head at the beginning of a pulldown position.
Figure 8:
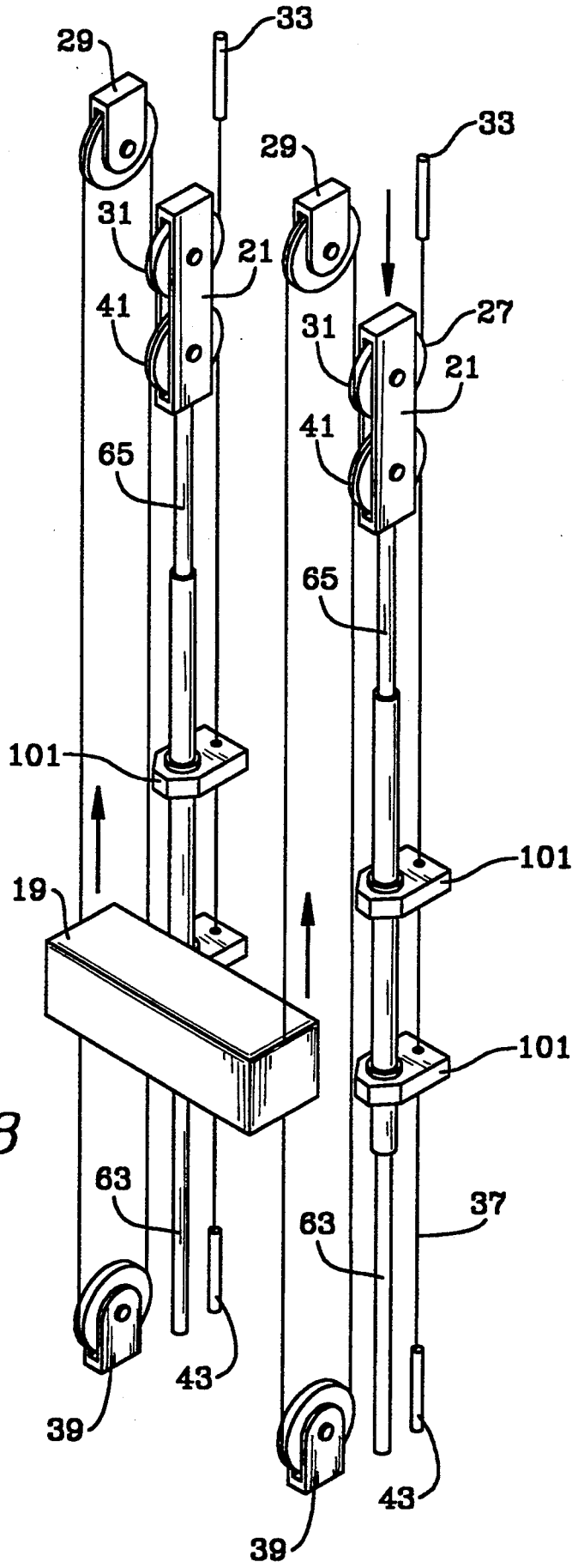
FIG. 8 is a view similar to FIG. 7, with the drilling head at the beginning of a pullback position.

The mast 5 is used to guide the rotary head 19 in a rectilinear up and down motion, as is well known. Any conventional guiding means will do, such as elements (not shown) that project from the head 19 into sliding engagement with channels (shown in phantom) in mast 5. The traveling sheave block 21 and the barrel 61 of the hydraulic cylinder means 60 will be guided in a similar manner. An acceptable arrangement is shown in FIGS. 7 and 8. Guide blocks 101 are fixed to mast 5 and permit cylinder barrel 61 to slide therethrough. Cable 37 extends through apertures in guide blocks 101. Any number of guide blocks can be so provided.

Figure 5:
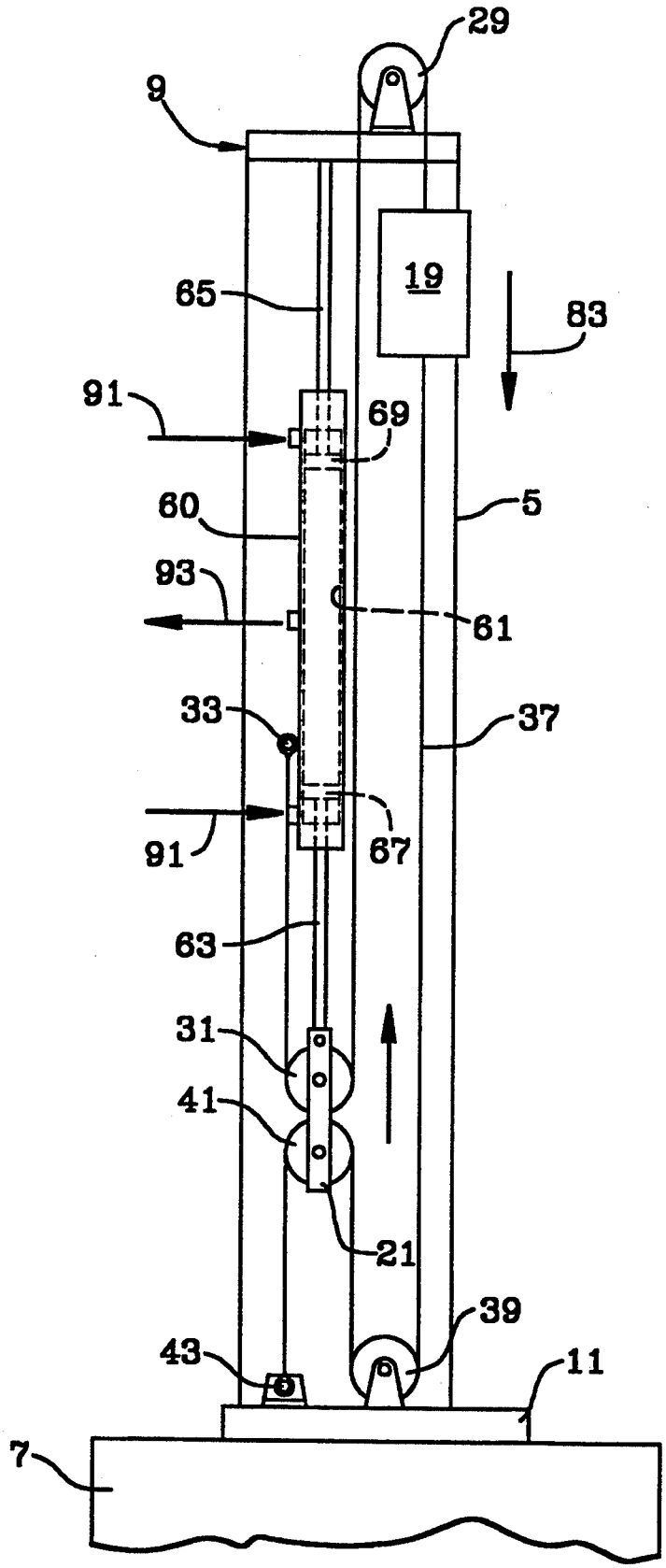
FIG. 5 is a schematic side elevational view of a cylinder feed system of an alternate embodiment of this invention, with the mast shown in phantom and other parts removed, with the drilling head at the end of a pullback position.
Figure 6:
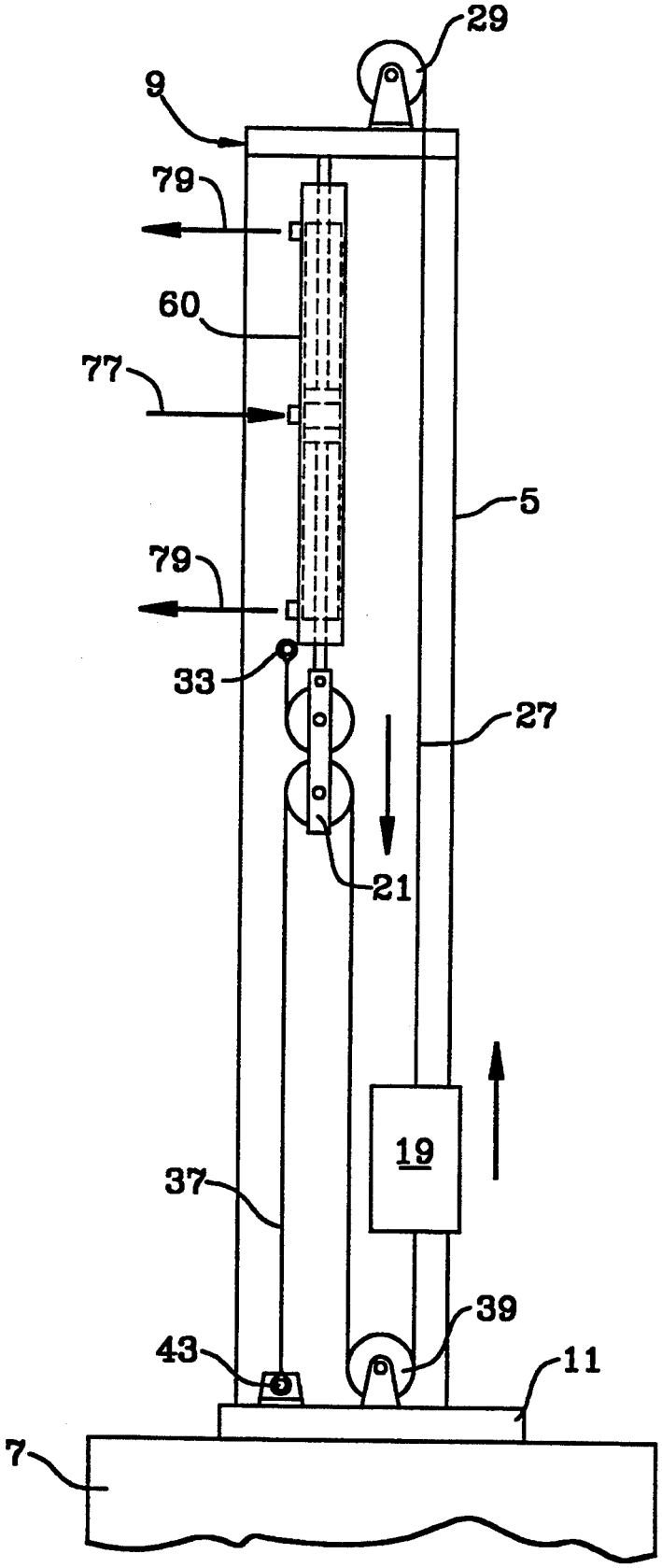
FIG. 6 is a view similar to FIG. 5 with the drilling head at the end of a pulldown position.

The described method above for attaching the cylinder 60 would normally be used for a machine which requires a larger pulldown load capacity. A higher load is applied to the pulldown chain/cable 37 if cylinder 60 is constructed to provide a larger internal projected area at cavity 71 between the two pistons 67, 69 being pressurized than between each piston 67, 69 and its adjacent end of the cylinder 60. This generates a force in the pulldown chain/cable 37 which pulls the rotary head down 19. For a machine that needs a larger pullback load capacity, cylinder 60 would be anchored to the mast crown 9 (See FIG. 5). End 43 of chains/cables 37 would be anchored to mast table 11, and end 33 of chains/cable 27 would be anchored to crown 9 at the top of mast 5. Traveling sheave 21 would be connected to bottom piston rod 65 and be positioned between piston rod 65 and mast table 11. Hydraulic flow for pulldown and pullback is the reverse from that as described hereinabove for FIGS. 3 and 4.

FIGS. 3–6 show the system with one double rod cylinder 61. We prefer to provide a plurality of side-by-side cylinders such as illustrated in FIGS. 7 and 8.

A double rod cylinder system of this invention effectively cuts in half the required stroke for each rod. Now each rod, if having the same size as its counterpart, can carry four times the load, meaning that the piston rods can be reduced in size and which leads to a smaller cylinder bore.

Figure 9:
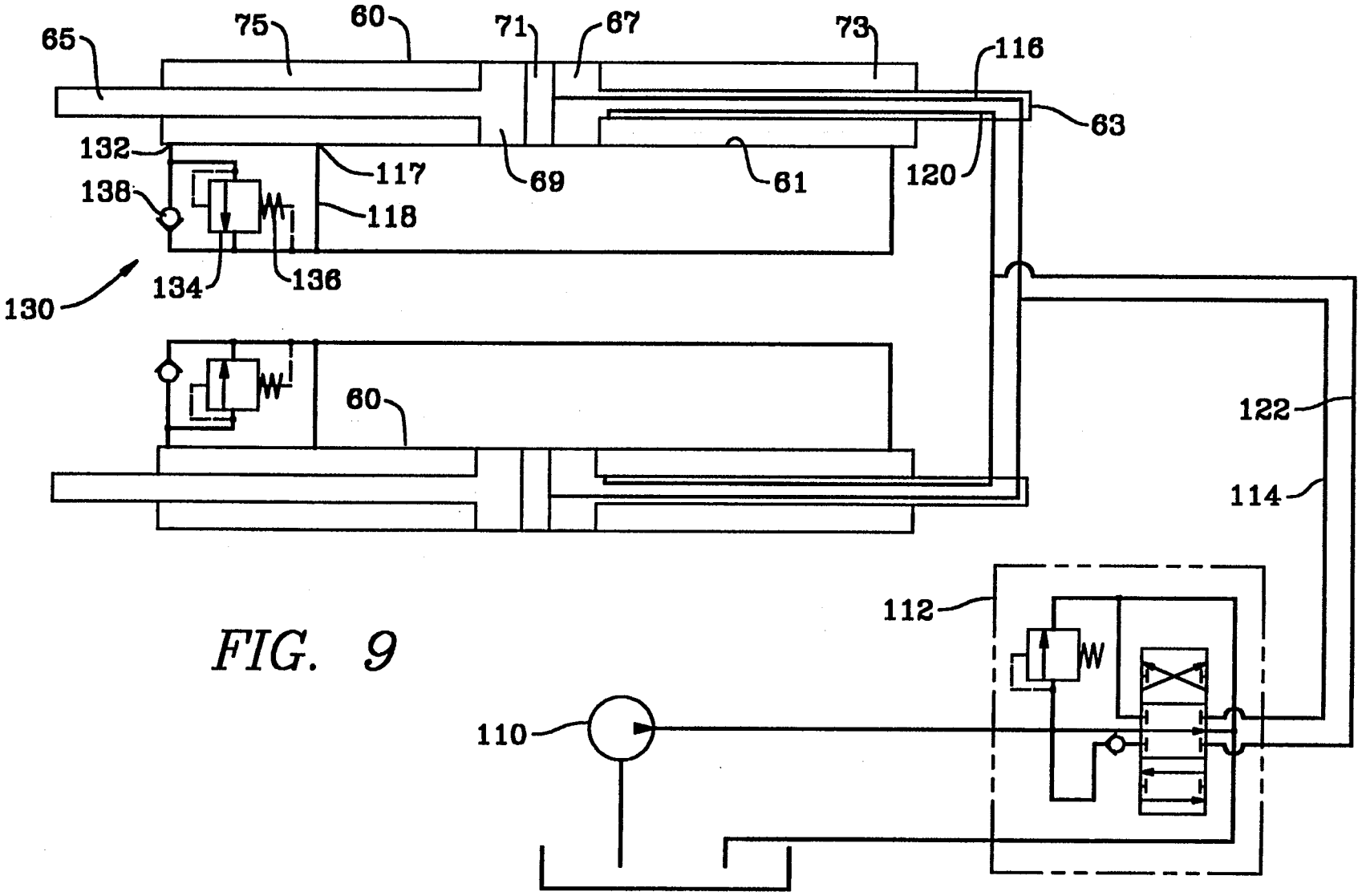
FIG. 9 is an exemplary schematic diagram of a hydraulic circuit for use with this invention.

FIG. 9 shows an exemplary hydraulic schematic circuit for feeding the system of this invention. Pump 110 pressurizes the system through directional valve 112. A pair of feed cylinders 60 is shown in the system. Both operate identically, and description of one will suffice for both.

At the beginning of the pulldown stroke, hydraulic fluid enters cavity 71 between pistons 67, 69 in barrel 61 via tubing 114, and passageway 116 provided through first piston rod 63. As piston rod 65 moves out of barrel 61, hydraulic fluid is forced out of chamber 75 and barrel 61 via aperture 117 into tubing 118. Tubing 118 carries fluid back into barrel 61 and chamber 73, to ultimately exit via passageway 120 in piston rod 63 to return tubing 122. Re-entry of fluid into barrel 61 permits the circuitry to move along with barrel 61. This avoids the need for providing flexible slack in tubing of the circuit, which slack would be required to permit movement of barrel 61.

A hydraulic subcircuit 130 is provided to act as a cushion to absorb the mechanical impact from piston 69 and cylinder head, when it reaches the end of its outward stroke. Aperture 132 connects reservoir 75 to tubing 118 via spring loaded valve 134. Valve 134 is normally closed. Aperture 117 becomes closed off when piston 69 passes aperture 117. Thereafter, pressure of fluid in chamber 75 increases to cause valve 134 to open, permitting fluid flow. The amount of tension in spring 136 can be varied, to vary the opening pressure for valve 134. On a reverse cycle, one-way valve 138 becomes opened, to permit reverse flow, until aperture 117 becomes opened, as is well known.

A reverse hydraulic flow will cause the reverse action on piston rods 63,65, pistons 67, 69 and chambers 71, 73 and 75, as is well known.

Having described the invention, what is claimed is:

1. In an earth drilling machine having a mast and a drilling head movable in a rectilinear motion between a mast crown and a mast table, means for moving said drilling head comprising:

(a) a double rod hydraulic cylinder having a first and second piston rod slidably mounted within a cylinder barrel, said first piston rod having one end extending out of a bottom of said cylinder barrel and said second piston rod having an end extending out of a top of said cylinder barrel, said cylinder barrel movable over at least part of the length of said mast;

(b) said first piston rod end being connected to said mast table;

(c) a traveling sheave block connected to said end of said second piston rod, said sheave block and said end of said second piston rod being movable over at least part of the length of said mast, said sheave block having an upper and lower sheave connected thereto;

(d) a crown sheave connected to said mast crown and a pulldown sheave connected to said mast table;

(e) a flexible pullback member having a first end connected to a top portion of said drilling head, a second end connected to said mast crown, and an intermediate portion reeved around both said crown sheave and said upper sheave on said traveling sheave block;

(f) a flexible pulldown member having a first end connected to a bottom portion of said drilling head, a second end connected to said mast at a location between said mast crown and said mast table, and an intermediate portion reeved around said pulldown sheave and said lower sheave on said traveling sheave block; and (g) hydraulic circuit means for activating said first and second piston rods, said circuit means having a portion thereof extending internally along a portion of length of only said first piston rod.

2. The drilling machine of claim 1 wherein said first piston rod has an associated piston head slidably positioned within said barrel and said second piston rod has an associated piston head slidably positioned within said barrel, said first and second piston heads being in fluid communication with a volumetrically variable chamber in said barrel for flow-in of hydraulic fluid during a pulldown cycle, and flow-out of hydraulic fluid during a pullback cycle.

3. The drilling machine of claim 2 wherein said first piston head is in fluid communication with a volumetrically variable chamber in said barrel between said first piston head and a bottom end of said barrel for flow-out of hydraulic fluid during the pulldown cycle, and for flow-in of hydraulic fluid during a pullback cycle.

4. The drilling machine of claim 3 wherein said second piston head is in fluid communication with a volumetrically variable chamber in said barrel between said second piston head and a top end of said barrel for flow-out of hydraulic fluid during the pulldown cycle, and for flow-in of hydraulic fluid during a pullback cycle.

5. The drilling machine of claim 4 wherein said mast has first guide means connected thereto for engaging and guiding said barrel during motion thereof.

6. The drilling machine of claim 5 wherein said mast has second guide means connected thereto for engaging and guiding said drilling head during motion thereof.

7. The drilling machine of claim 6 wherein said flexible pulldown member and said flexible pullback member each is a cable.

8. The drilling machine of claim 7 wherein said flexible pulldown member and said flexible pullback member each is a chain.

9. A hydraulic system for moving a drilling head in a rectilinear motion between a mast crown and a mast table on a drilling machine comprising:

(a) double rod hydraulic cylinder movable over at least a part of the length of said mast, said cylinder including a cylinder barrel having slidably disposed therein a first and second piston rod spaced apart in non-telescopic relation to each other, said first piston rod being connected at a bottom end to a mast table, said second piston rod being connected at a top end to a traveling sheave block;

(b) said sheave block and said top end of said second piston rod being movable over at least part of the length of the mast, said sheave block having an upper and lower sheave connected thereto;

(c) first flexible connector means for connecting a bottom end of said drilling head to said mast through a first sheaving on said mast table and through said lower sheave of said sheave block;

(d) second flexible connector means for connecting a top end of said drilling head to said mast crown through a second sheaving on said mast crown and through said upper sheave on said sheave block; and (e) hydraulic feed means for actuating said cylinder to move said sheave block and said drilling head alternately in a first pulldown direction and in a second pullback direction said hydraulic feed means having a portion thereof located internally within only said first piston rod in said hydraulic cylinder.

10. A hydraulic system for moving a drilling head in a rectilinear motion between a mast crown and a mast table on a drilling machine comprising:

(a) plurality of double rod hydraulic cylinders movable over at least a part of the length of said mast, each of said cylinders including a cylinder barrel having slidably disposed therein a first and second piston rod spaced apart in non-telescopic relation to each other, each of said first piston rods being connected at a bottom end to a mast table and each of said second piston rods being connected at a top end to a traveling sheave block;

(b) each of said sheave blocks and each of said top end of said second pistons being movable over at least part of the length of the mast, said sheave blocks having an upper and lower sheave connected thereto;

(c) first flexible connector means associated with each hydraulic cylinder for connecting a bottom end of said drilling head to said mast through a first sheaving on said mast table and through said lower sheave of each sheave block;

(d) second flexible connector means associated with each hydraulic cylinder for connecting a top end of said drilling head to said mast crown through a second sheaving on said mast crown and through said upper sheave on each sheave block; and (e) hydraulic feed means for actuating each of said hydraulic cylinders to move said sheave blocks and said drilling head alternately in a first pulldown direction and in a second pullback direction said hydraulic feed means having a portion thereof located internally within only said first piston rod in each of said hydraulic cylinders.

11. A hydraulic system for moving a drilling head in a rectilinear motion between a mast crown and a mast table on a drilling machine comprising:

(a) double rod hydraulic cylinder movable over at least a part of the length of said mast, said cylinder including a cylinder barrel having slidably disposed therein a first and second piston rod spaced apart in non-telescopic relation to each other, said second piston rod being connected at a top end to a mast crown and said first piston rod being connected at a bottom end to a traveling sheave block;

(b) said sheave block and said bottom end of said first piston rod being movable over at least part of the length of the mast, said sheave block having an upper and lower sheave connected thereto;

(c) first flexible connector means for connecting a bottom end of said drilling head to said mast table through a first sheaving on said mast table and through said lower sheave of said sheave block;

(d) second flexible connector means for connecting a top end of said drilling head to said mast through a second shearing on said mast crown and through said upper sheave on said sheave block; and (e) hydraulic feed means for actuating said cylinder to move said sheave block and said drilling head alternately in a first pulldown direction and in a second pullback direction said hydraulic feed means having a portion thereof located internally within only said second piston rod in said hydraulic cylinder.

* * * * *